US011558936B2

(12) United States Patent
Yoshino et al.

(10) Patent No.: US 11,558,936 B2
(45) Date of Patent: Jan. 17, 2023

(54) MICROWAVE PROCESSING DEVICE

(71) Applicant: Panasonic Corporation, Osaka (JP)

(72) Inventors: Koji Yoshino, Shiga (JP); Masayuki Kubo, Shiga (JP); Osamu Hashimoto, Tokyo (JP); Ryosuke Suga, Kanagawa (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 598 days.

(21) Appl. No.: 16/611,200

(22) PCT Filed: Jun. 28, 2018

(86) PCT No.: PCT/JP2018/024538
§ 371 (c)(1),
(2) Date: Nov. 5, 2019

(87) PCT Pub. No.: WO2019/009174
PCT Pub. Date: Jan. 10, 2019

(65) Prior Publication Data

US 2020/0163173 A1 May 21, 2020

(30) Foreign Application Priority Data

Jul. 4, 2017 (JP) ..... JP2017-130891

(51) Int. Cl.
*H05B 6/68* (2006.01)
*H05B 6/66* (2006.01)
*H05B 6/72* (2006.01)

(52) U.S. Cl.
CPC ..... *H05B 6/681* (2013.01); *H05B 6/664* (2013.01); *H05B 6/682* (2013.01); *H05B 6/72* (2013.01)

(58) Field of Classification Search
CPC ..... H05B 6/664; H05B 6/681; H05B 6/682; H05B 6/70; H05B 6/72
(Continued)

(56) References Cited

U.S. PATENT DOCUMENTS 8,022,342 B2 * 9/2011 Kanechika ..... H01J 65/044 219/760
2003/0193299 A1 * 10/2003 Choi ..... H01J 65/044 315/248
2010/0243645 A1 9/2010 Ishizaki et al.

FOREIGN PATENT DOCUMENTS

JP 56-102096 8/1981
WO 2009/139136 11/2009
WO 2017/081855 5/2017

OTHER PUBLICATIONS

Translation of WO 2017/081855A1, "Microwave Heating Device", May 18, 2017, By ProQuest (Year: 2017).*
(Continued)

*Primary Examiner* — Quang T Van
(74) *Attorney, Agent, or Firm* — Wenderoth, Lind & Ponack, L.L.P.

(57) ABSTRACT

A microwave treatment apparatus includes a treatment chamber, a microwave supply, and a resonator unit. The treatment chamber is surrounded by a plurality of walls, and accommodates a heating target. The microwave supply supplies a microwave to the treatment chamber. The resonator unit is provided on one wall of the plurality of walls, and the resonator unit has a resonance frequency in a frequency band of the microwave. In this embodiment, the impedance of the surface of the resonator unit can be changed by controlling the frequency of the microwave supplied to the treatment chamber. This makes it possible to control the standing wave distribution within the treatment chamber, that is, the microwave energy distribution within
(Continued)

the treatment chamber. As a result, in the cases where a plurality of heating targets need to be heated simultaneously, desired dielectric heating is conducted for each of the heating targets.

11 Claims, 11 Drawing Sheets

(58) Field of Classification Search
USPC ..... 219/761, 745, 748, 678, 696, 708, 750, 219/746, 747, 756, 728, 679, 710, 713, 219/714, 702, 729, 741, 743, 737, 738, 219/711, 716, 734, 736, 685
See application file for complete search history.

(56) References Cited

OTHER PUBLICATIONS

International Search Report of PCT application No. PCT/JP2018/024538 dated Sep. 4, 2018.

* cited by examiner

In case of 2.40 GHz

Ratio of absorbed electric power 1.0 : 1

In case of 2.44 GHz

Ratio of absorbed electric power 1.7 : 1

In case of 2.45 GHz

Ratio of absorbed electric power 2.7 : 1

In case of 2.46 GHz

Ratio of absorbed electric power 0.5 : 1

In case of 2.50 GHz

Ratio of absorbed electric power 0.8 : 1

MICROWAVE PROCESSING DEVICE

CROSS-REFERENCE TO RELATED APPLICATIONS

This application is a U.S. national stage application of the PCT International Application No. PCT/JP2018/024538 filed on Jun. 28, 2018, which claims the benefit of foreign priority of Japanese patent application 2017-130891 filed on Jul. 4, 2017, the contents all of which are incorporated herein by reference.

TECHNICAL FIELD

The present disclosure relates to a microwave treatment apparatus that dielectrically heats a heating target such as food.

BACKGROUND ART

Microwave ovens are typical examples of microwave treatment apparatus. In an microwave oven, microwaves are generated by a magnetron, which is a microwave generating and radiating unit, and the microwaves are supplied into a treatment chamber that is surrounded by walls, which are made of metal. A heating target placed in the treatment chamber is dielectrically heated by the microwaves.

The microwaves are repeatedly reflected on the walls inside the treatment chamber. Each of the walls may be provided with small cavities that are capable of confining the microwaves. When the walls are of this type, the microwave reflected on a wall has a phase difference of 180 degrees with respect to the microwave applied to the wall.

Assuming that the line perpendicular to the wall is a reference line, the incident angle, which is the angle between the reference line and the incident wave, is equal to the reflection angle, which is the angle between the reflected wave and the reference line.

Generally, the size of the treatment chamber is sufficiently large relative to the wavelength of the microwaves (about 120 mm in the case of microwave oven). For this reason, a standing wave occurs in the treatment chamber due to the behavior of the incident wave and the reflected wave at the wall.

Electric field is constantly strong at the antinodes of the standing wave, but electric field is constantly weak at the nodes of the standing wave. Accordingly, the heating target is heated intensively when placed at a position that corresponds to an antinode of the standing wave, while the heating target is not so much heated when placed at a position that corresponds to a node of the standing wave. In other words, the heating target is heated differently depending on the placement position of the heating target. This is a primary cause of uneven heating taking place in the microwave oven.

The practically viable methods for preventing uneven heating include a so-called turntable system of rotating the table on which the heating target is placed, and a so-called rotary antenna system of rotating the antenna that radiates microwaves. Although these methods are unable to eliminate the standing wave, these methods are used as the methods that achieve uniform heating for food.

In contrast to the uniform heating, a microwave heating apparatus that intentionally performs localized heating has been developed (see, for example, Non-Patent Literature 1).

This apparatus includes a plurality of microwave generators configured using a GaN semiconductor element. In this apparatus, microwaves generated by each of the microwave generators are supplied from different positions to the treatment chamber, and the phases of the microwaves are controlled, so as to focus the microwaves onto the heating target for localized heating,

CITATION LIST

Non-Patent Literature

Non-Patent Literature 1: National Research and Development Agency, New Energy and Industrial Technology Development Organization et. al, "Development of industrial microwave heating system that uses GaN amplifier modules as heat sources," Jan. 25, 2016

SUMMARY

However, the above-described conventional microwave treatment apparatus requires that, in order to conduct localized heating, microwaves need to be supplied from a plurality of locations to the treatment chamber, which leads to the problem of complication and size increase in the apparatus.

For example, in cases where a plurality of heating targets need to be heated simultaneously, one of the heating targets does not absorb all the microwaves even if the microwaves are focused on the one of the heating targets. The microwaves that have not been absorbed by the heating target can be incident on the other heating target. Therefore, when a plurality of heating targets need to be heated simultaneously, it is difficult for the above-described conventional microwave treatment apparatus to improve the intensity of localized heating.

In order to solve these and other problems in the prior art, an object of the present disclosure is to provide a microwave treatment apparatus that can perform desired dielectric heating onto each of a plurality of heating targets by controlling the standing wave distribution in the treatment chamber.

In an embodiment of the present disclosure, a microwave treatment apparatus includes a treatment chamber, a microwave supply, and a resonator unit. The treatment chamber is surrounded by a plurality of walls, and accommodates a heating target. The microwave supply supplies a microwave to the treatment chamber. The resonator unit is provided on one wall of the plurality of walls, and the resonator unit has a resonance frequency in a frequency band of the microwave.

According to the present disclosure, the impedance of the surface of the resonator unit can be changed by controlling the frequency of the microwave supplied to the treatment chamber. This makes it possible to control the standing wave distribution in the treatment chamber, that is, the microwave energy distribution in the treatment chamber. As a result, in the case where a plurality of heating targets need to be heated simultaneously, desired dielectric heating is conducted for each of the heating targets.

DESCRIPTION OF EMBODIMENTS

In a first aspect of the present disclosure, a microwave treatment apparatus includes a treatment chamber, a microwave supply, and a resonator unit. The treatment chamber is surrounded by a plurality of walls, and accommodates a heating target. The microwave supply supplies a microwave to the treatment chamber. The resonator unit is provided on one wall of the plurality of walls, and the resonator unit has a resonance frequency in a frequency band of the microwave.

In a microwave treatment apparatus according to a second aspect of the present disclosure, in addition to the first aspect, the resonator unit includes one or more patch resonators.

In a microwave treatment apparatus according to a third aspect of the present disclosure, the one or more resonators are arranged so that a patch surface faces inside of the treatment chamber, and an opposite surface to the patch surface has a potential equal to the potential of the wall of the treatment chamber, in addition to the second aspect.

In a microwave treatment apparatus according to a fourth aspect of the present disclosure, in addition to the second aspect, the one or more patch resonators are arranged in a matrix.

In a microwave treatment apparatus according to a fifth aspect of the present disclosure, in addition to the second aspect, all of the one or more patch resonators are disposed on one wall of the plurality of walls.

In a microwave treatment apparatus according to a sixth aspect of the present disclosure, in addition to the fifth aspect, the resonator unit is disposed in one of equally divided regions in which one wall of the plurality of walls is equally divided.

In a microwave treatment apparatus according to a seventh aspect of the present disclosure, in addition to the first aspect, the microwave supply includes a power feeder provided in one wall of the plurality of walls and configured to supply the microwave to the treatment chamber, and the resonator unit is disposed on another one wall of the plurality of walls that is opposite to the power feeder.

In a microwave treatment apparatus according to an eighth aspect of the present disclosure, in addition to the first aspect, the microwave supply includes a microwave generator and a controller. The microwave generator generates a microwave. The controller controls the microwave generator to adjust an oscillation frequency of the microwave, Hereafter, exemplary embodiments of the microwave treatment apparatus according to the present disclosure will be described with reference to the drawings.

First Exemplary Embodiment

Figure 1:
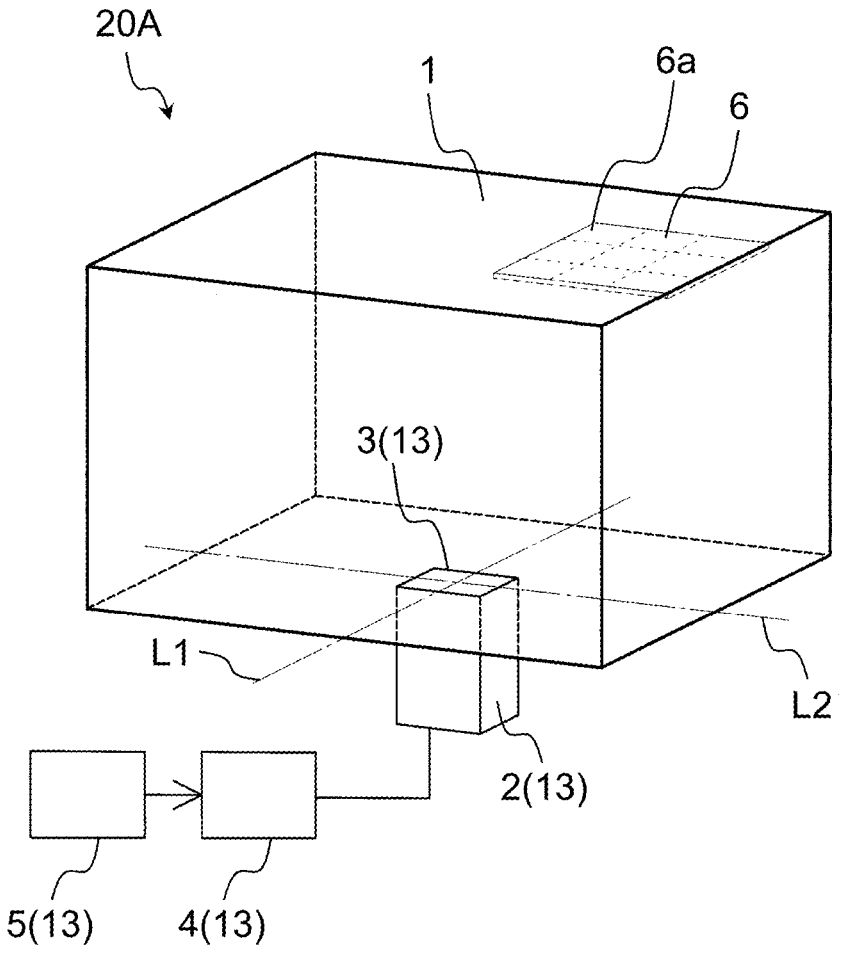
FIG. 1 is a block diagram illustrating a microwave treatment apparatus according to a first exemplary embodiment.

FIG. 1 is a block diagram illustrating microwave treatment apparatus 20A according to the first exemplary embodiment of the present disclosure. As shown in FIG. 1, microwave treatment apparatus 20A includes treatment chamber 1 surrounded by a plurality of walls made of metal, and microwave supply 13 configured to supply a microwave to treatment chamber 1.

Microwave supply 13 includes microwave transmitter 2, power feeder 3, microwave generator 4, and controller 5. Microwave transmitter 2 has a rectangular-shaped cross section and transmits the microwave in a TE10 mode. Power feeder 3 is a rectangular-shaped opening provided in the bottom wall of treatment chamber 1. The center of power feeder 3 is positioned at the center of the bottom wall of treatment chamber 1, that is, the intersection point of center line L1 along the side-to-side axis and center line L2 along the forward and backward axis of treatment chamber 1.

Microwave generator 4 is able to adjust the oscillation frequency of the microwaves to be generated. Controller 5 controls microwave generator 4 based on input information to adjust the oscillation frequency and the output power of the microwave generated by microwave generator 4 to desired values. The controllable frequency band of the oscillation frequency is from 2.4 GHz to 2.5 GHz. The resolution is, for example, 1 MHz.

In treatment chamber 1, resonator unit 6 is provided on the top wall that is opposite to power feeder 3. Resonator unit 6 is provided at the rightmost end of the top wall with respect to the side-to-side axis and at the center of the top wall with respect to the forward and backward axis.

Figure 2:
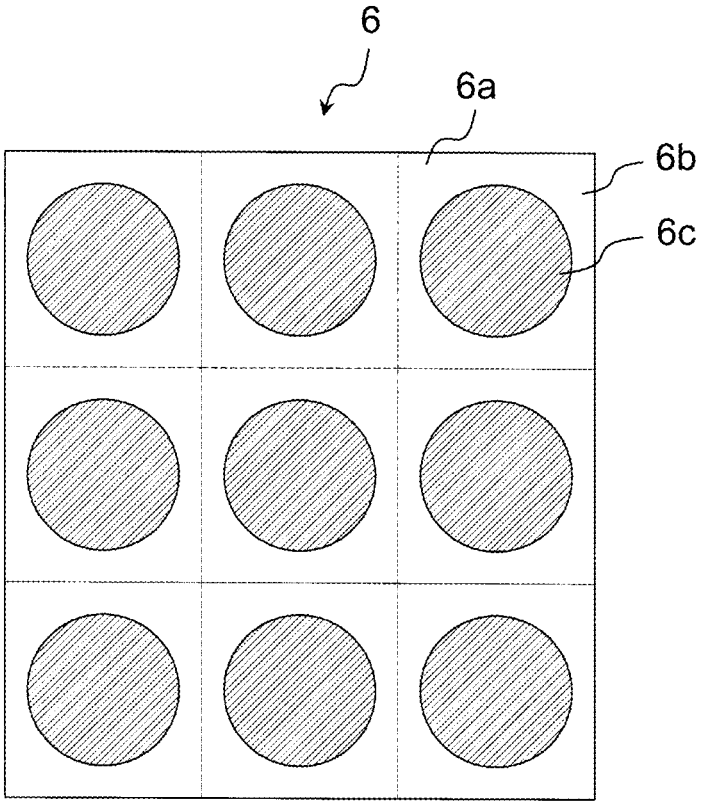
FIG. 2 is a plan view illustrating the configuration of a resonator unit.

FIG. 2 is a plan view illustrating the configuration of resonator unit 6. As shown in FIG. 2, resonator unit 6 includes nine patch resonators 6*a*. Nine patch resonators 6*a* are arranged in a matrix. In the present exemplary embodiment, nine patch resonators 6*a* are arranged in three rows and three columns (3×3). Hereinafter, this matrix configuration is referred to as a segment configuration.

Each of patch resonators 6*a* has a resonance frequency in the frequency band of the microwave generated by microwave generator 4. Each of patch resonators 6*a* includes dielectric 6*b* and conductor 6*c*. Dielectric 6*b* is a dielectric substrate having a predetermined dielectric characteristic. Conductor 6*c* is a circular plate-shaped conductor provided on dielectric 6*b*.

Patch resonators 6*a* are provided on the top wall of treatment chamber 1 so that the surface on which conductors 6*c* are provided faces inside of treatment chamber 1. The opposite surface to the surface on which conductor 6*c* is provided, that is, the reverse surface of dielectric 6*b*, is directly in contact with the wall of treatment chamber 1, and has a potential equal to the potential of the wall of treatment chamber 1. Hereinafter, the surface on which conductor 6*c* is provided is referred to as a patch surface of resonator unit 6.

Patch resonators 6*a* have a characteristic such that the phase difference between the microwave incident on conductor 6*c* and the microwave reflected on conductor 6*c* is dependent on the frequency of the microwave incident on conductor 6*c*. Hereinafter, this phase difference is referred to as a reflection phase.

Figure 3:
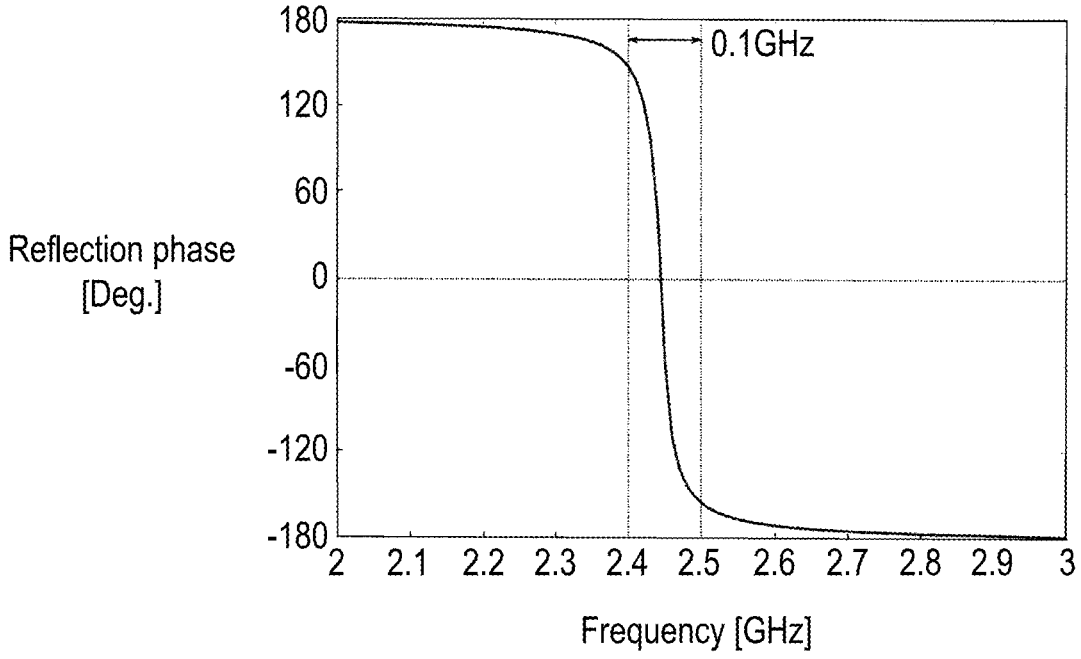
FIG. 3 is a graph illustrating the frequency characteristic of a reflection phase that is generated by a patch resonator.

FIG. 3 is a graph illustrating the frequency characteristic of the reflection phase that is generated by patch resonators 6*a*. As shown in FIG. 3, the reflection phase of patch resonators 6*a* is approximately 180 degrees in the case of 2 GHz, and approximately −180 degrees in the case of 3 GHz. In the frequency band of 2.4 GHz to 2.5 GHz, the reflection phase of patch resonators 6*a* changes greatly from approximately +180 degrees to approximately −180 degrees.

Hereinafter, the functions and characteristics of microwave treatment apparatus 20A will be described with reference to the example in which treatment chamber 1 accommodates two heating targets 8 and 9.

Figure 4:
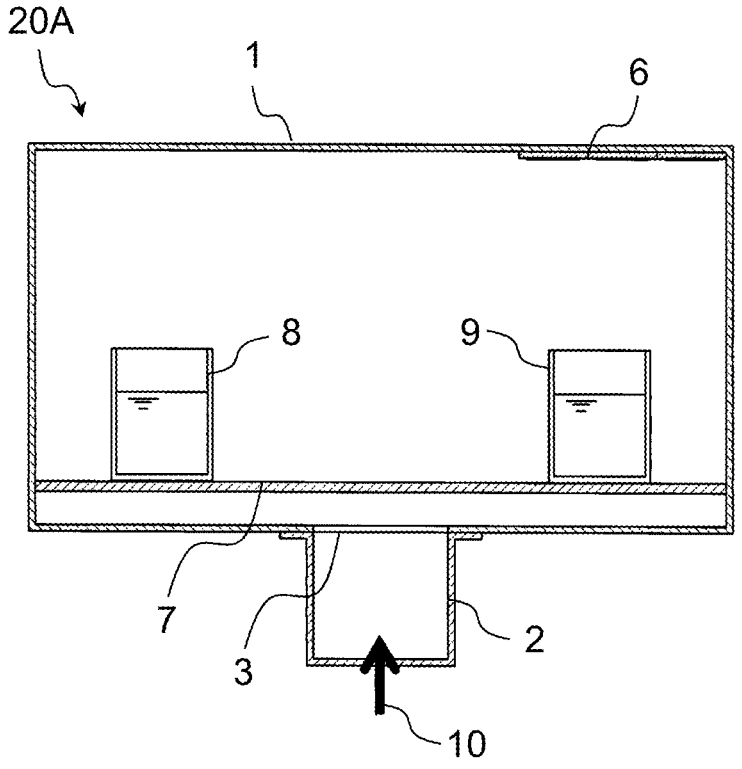
FIG. 4 is a vertical cross-sectional view of the microwave treatment apparatus according to the first exemplary embodiment, in which two heating targets are accommodated in the treatment chamber.

FIG. 4 is a vertical cross-sectional view of microwave treatment apparatus 20A in which two heating targets are accommodated in treatment chamber 1. Referring to FIG. 4, heating targets 8 and 9 are arranged respectively on the left side and on the right side in treatment chamber 1.

As shown in FIG. 4, mounting plate 7 made of a low dielectric loss material is disposed above power feeder 3 so as to cover power feeder 3. Heating targets 8 and 9 are placed on mounting plate 7. In this state, microwave generator 4 supplies microwave 10 having a predetermined frequency.

Figure 5:
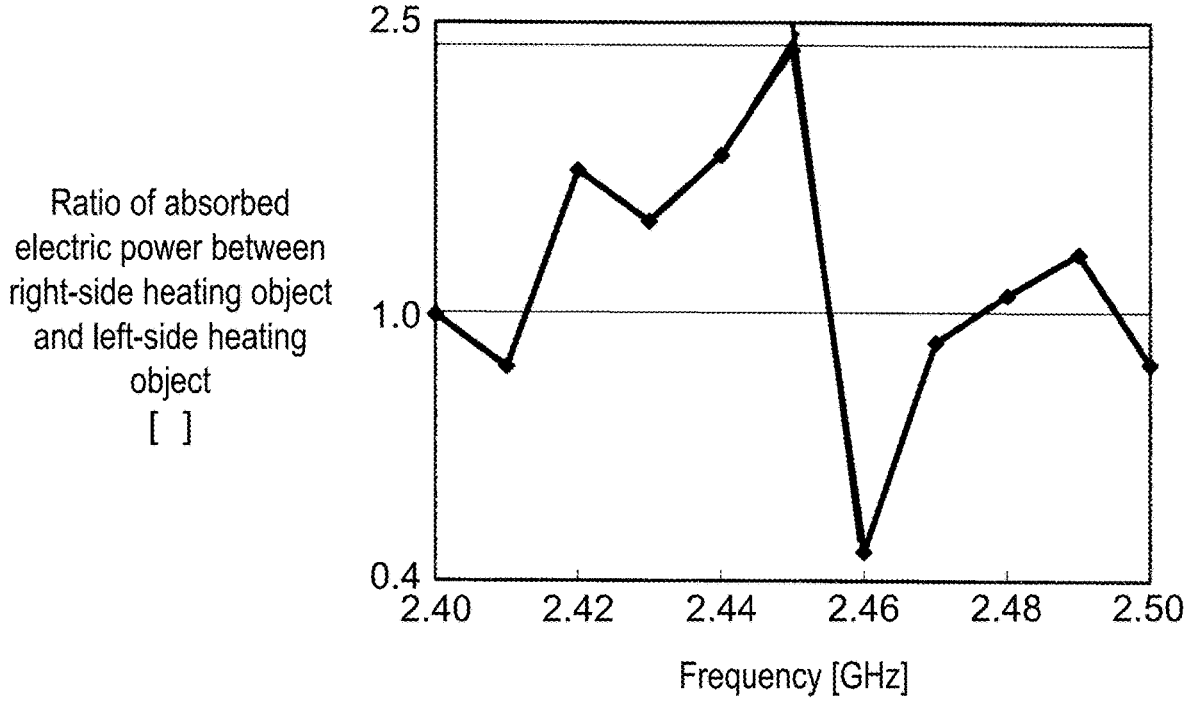
FIG. 5 is a graph illustrating the frequency characteristic of the ratio of electric power absorbed by the two heating targets accommodated in the treatment chamber.

FIG. 5 is a graph illustrating the frequency characteristic of the ratio of electric power absorbed by heating targets 8 and 9. More specifically, the ratio of the absorbed electric power refers to the ratio of the electric power absorbed by heating target 8 with respect to the electric power absorbed by heating target 9.

As shown in FIG. 5, when the frequency of the supplied microwave is set to 2.45 GHz, the electric power absorbed by heating target 8 is equal to or greater than 2.5 times the electric power absorbed by heating target 9.

Figure 6A:
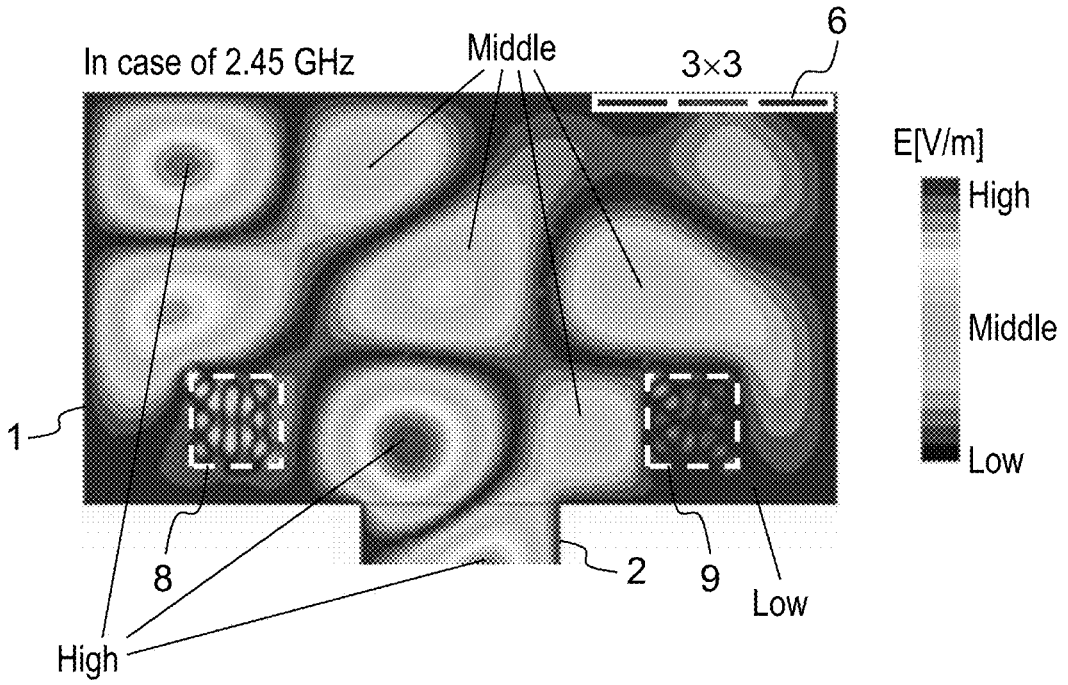
FIG. 6A is a view illustrating an electric field distribution in the treatment chamber of FIG. 4.
Figure 6B:
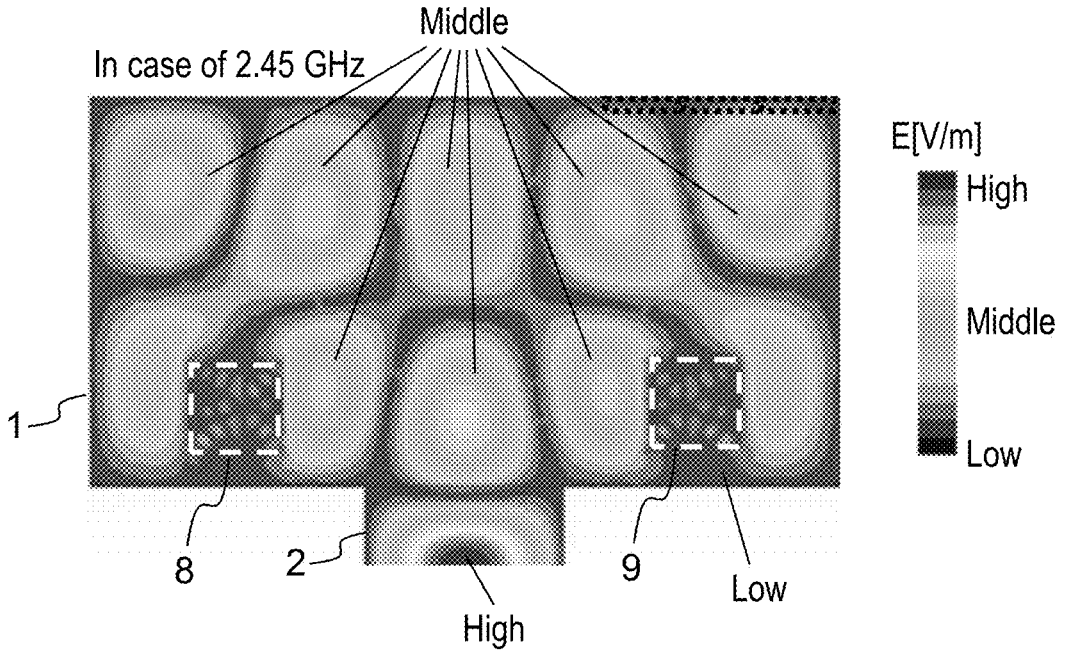
FIG. 6B is a view illustrating an electric field distribution in the treatment chamber of FIG. 4, in the case where the resonator unit is not provided.
Figure 7A:
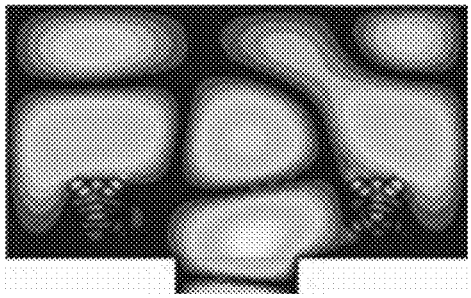
FIG. 7A is a view illustrating an electric field distribution in the treatment chamber in the case where the frequency of the microwave is 2.40 GHz.
Figure 7B:
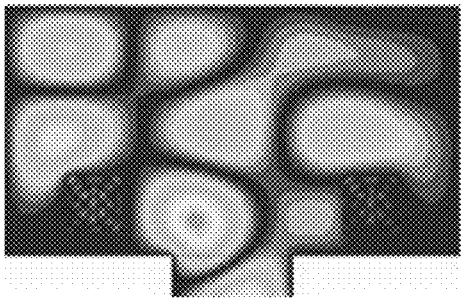
FIG. 7B is a view illustrating an electric field distribution in the treatment chamber in the case where the frequency of the microwave is 2.44 GHz.
Figure 7C:
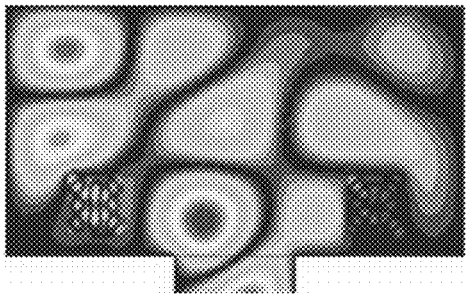
FIG. 7C is a view illustrating an electric field distribution in the treatment chamber in the case where the frequency of the microwave is 2.45 GHz.
Figure 7D:
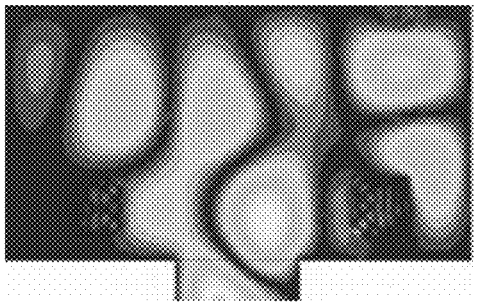
FIG. 7D is a view illustrating an electric field distribution in the treatment chamber in the case where the frequency of the microwave is 2.46 GHz.
Figure 7E:
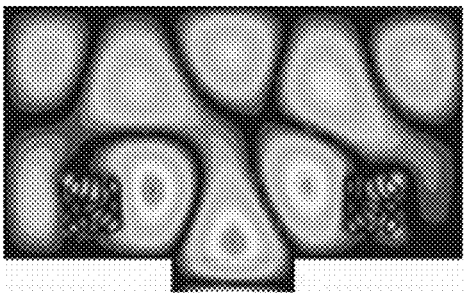
FIG. 7E is a view illustrating an electric field distribution in the treatment chamber in the case where the frequency of the microwave is 2.50 GHz.

FIGS. 6A and 6B show the experiment results for elucidating this phenomenon. FIG. 6A illustrates an electric field distribution within treatment chamber 1 of FIG. 4. FIG. 6B illustrates the electric field distribution within treatment chamber 1 of FIG. 4, in the case where resonator unit 6 is not provided.

As shown in FIG. 6A, a deflected standing wave distribution in which the electric field in the vicinity of resonator unit 6 weakens appears in treatment chamber 1 in which heating target 8 is accommodated.

As shown in FIG. 3, the reflection phase of patch resonator 6*a* is about 0 degrees with regard to a 2.45 GHz microwave. Taking into consideration that the phase difference between the incident wave and the reflected wave on an ordinary wall is 180 degrees, it will be understood that a standing wave distribution that is different from a normal one is formed in the vicinity of the location where resonator unit 6 is disposed.

A reflection phase of about 0 degrees means that the impedance is infinite. Therefore, the high-frequency current passing through the patch surface is suppressed, and the microwave moves away from the space in the vicinity of resonator unit 6. As a result, the electric field in the vicinity of resonator unit 6 weakens.

That is, as shown in FIG. 6A, resonator unit 6 is able to deflect the standing wave distribution within treatment chamber 1. As a result, a stronger electric field is formed in treatment chamber 1 than in the case where resonator unit 6 is not provided (see FIG. 6B). This electric field is able to increase the electric power absorbed by heating target 8 to about 2.5 times the electric power absorbed by heating target 9.

FIGS. 7A to 7E each shows an electric field distribution within treatment chamber 1 when the frequency of the microwave supplied to treatment chamber 1 is varied. FIGS. 7A to 7E show electric field distributions in treatment chamber 1 in the cases where the frequency of the microwave supplied to treatment chamber 1 is 2.40 GHz, 2.44 GHz, 2.45 GHz, 2.46 GHz, and 2.50 GHz, respectively.

As shown in FIGS. 7A to 7E, in order to change the electric field distribution within treatment chamber 1 more significantly, it is preferable to supply a microwave having a frequency such that the reflection phase on the patch surface results in nearly 0 degrees (see FIG. 3).

In addition to the foregoing structures and effects, the following additional variations are possible.

Because resonator unit 6 is configured using patch resonators 6*a*, resonator unit 6 may be a flat structure. As a result, resonator unit 6 can be disposed inside treatment chamber 1 without taking up much space.

Because all the patch resonators 6*a* are disposed on one of the walls, the change of standing wave distribution caused by resonator unit 6 can be predicted more easily than in the case where patch resonators 6*a* are provided on a plurality of walls. This makes it easy to control heating of heating targets 8 and 9.

Because resonator unit 6 is disposed on the wall of treatment chamber 1 that is opposite to power feeder 3, the microwave energy distribution can be brought closer to power feeder 3. As a result, heating targets 8 and 9 can be heated efficiently together with the energy from power feeder 3.

By controlling the frequency of the microwave, the reflection phase of resonator unit 6 is changed so that the standing wave distribution, i.e., the microwave energy distribution, within treatment chamber 1 can be controlled. Therefore, for example, when heating targets 8 and 9 need to be heated simultaneously, the microwave energy absorbed by each of heating targets 8 and 9 can be controlled.

In the case where a 2.46 GHz microwave is supplied, the ratio of electric power absorbed by two heating targets can be inverted from the case where a 2.45 GHz microwave is supplied. This allows heating targets 8 and 9 to be heated in different ways.

For example, when heating target 8, which is disposed on the left side of FIG. 4, needs to be heated more intensively, a microwave having a frequency of 2.45 GHz is supplied. When heating target 9, which is disposed on the right side of FIG. 4, needs to be heated more intensively, a microwave having a frequency of 2.46 GHz is supplied.

When both need to be heated evenly, a microwave having a frequency of 2.40 GHz or slightly lower than 2.50 GHz (about 2.495 GHz) should be supplied. It is sufficient that the oscillation frequency of the microwave have a resolution of 1 MHz.

According to the present exemplary embodiment, the impedance of the surface of resonator unit 6 can be changed by controlling the frequency of the microwave supplied to treatment chamber 1. This makes it possible to control the standing wave distribution within treatment chamber 1, that is, the microwave energy distribution within treatment chamber 1. As a result, in cases where a plurality of heating targets need to be heated simultaneously, desired dielectric heating is conducted for each of the heating targets.

Second Exemplary Embodiment

Figure 8:
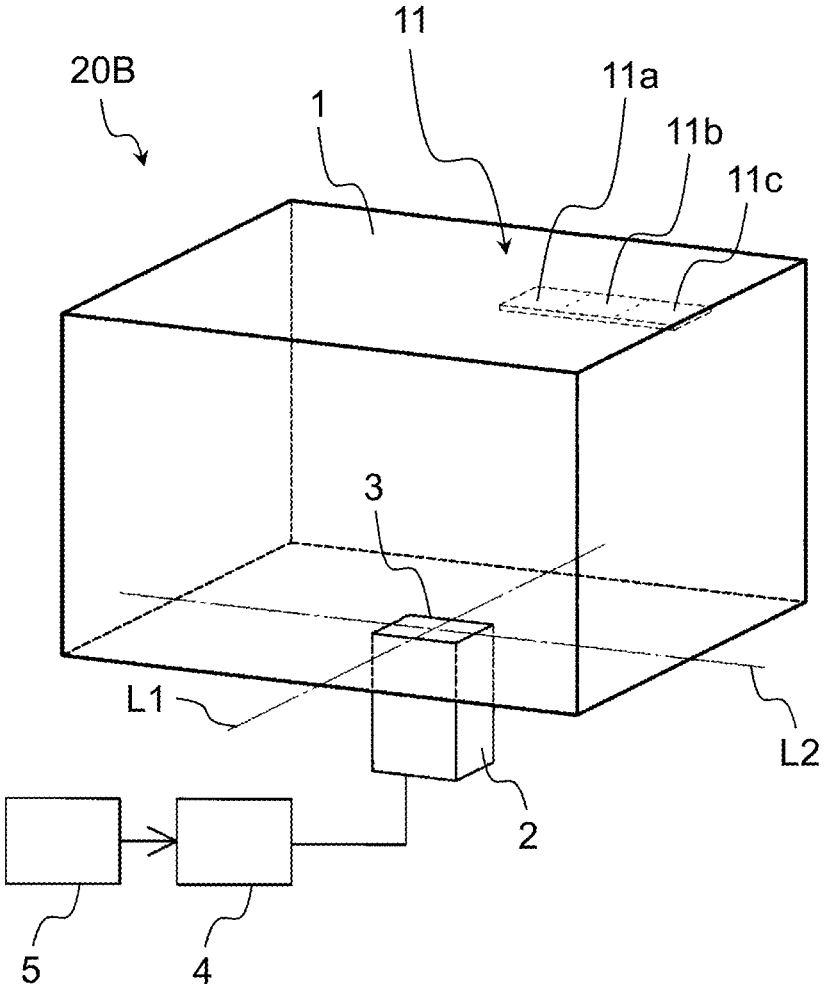
FIG. 8 is a block diagram illustrating a microwave treatment apparatus according to a second exemplary embodiment.
Figure 9:
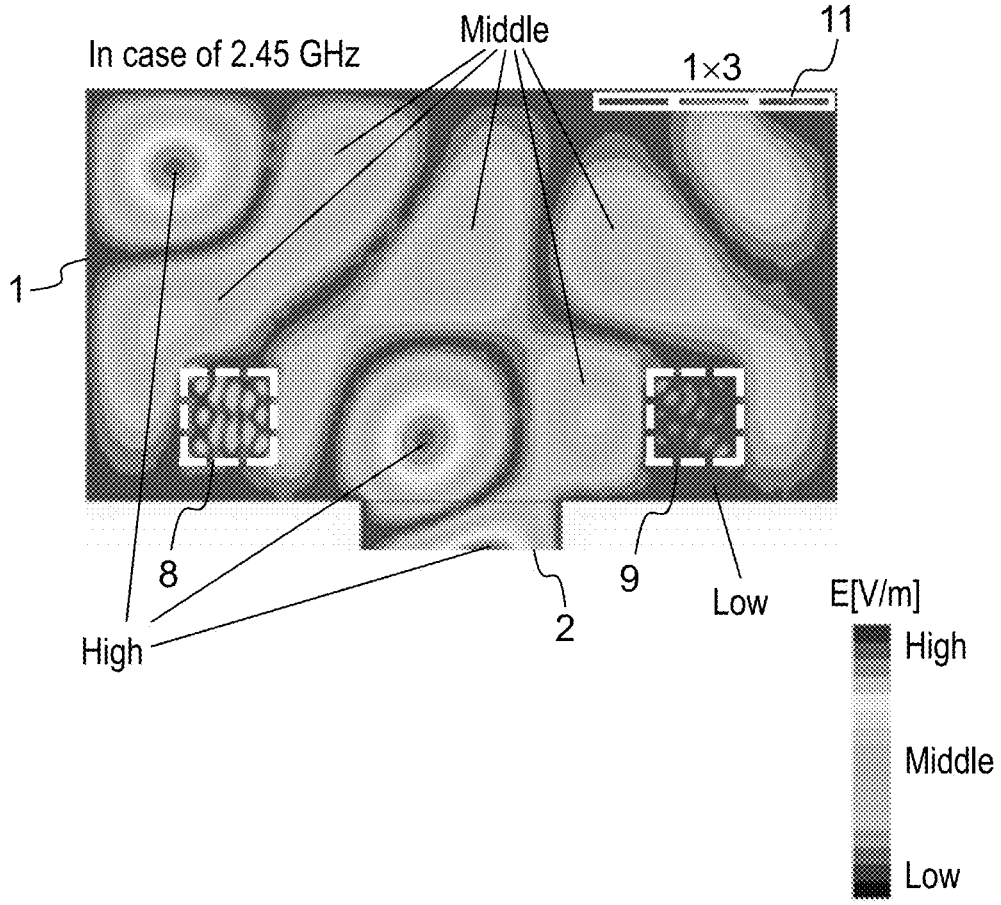
FIG. 9 is a view illustrating an electric field distribution in the treatment chamber shown in FIG. 8.

Referring to FIGS. 8 and 9, microwave treatment apparatus 20B according to a second exemplary embodiment of the present disclosure will be described. In the following description, same or similar elements are designated by the same reference signs as used in the first exemplary embodiment, and the description of such same or similar elements will not be repeated.

FIG. 8 is a block diagram illustrating microwave treatment apparatus 20B according to the present exemplary embodiment. FIG. 9 illustrates an electric field distribution within treatment chamber 1 in the case where a 2.45 GHz microwave is supplied to treatment chamber 1 that accommodates two heating targets, like FIG. 4.

As shown in FIG. 8, resonator unit 11 is provided at the rightmost end of the top wall with respect to the side-to-side axis and at the center of the top wall with respect to the forward and backward axis. Resonator unit 11 includes patch resonator 11*a*, patch resonator lib, and patch resonator 11*c*. Patch resonators 11*a*, 11*b*, and 11*c* are arranged in one row along the side-to-side axis. In other words, resonator unit 11 has a one-row by three-column (1×3) segment configuration.

Each of patch resonators 11*a*, 11*b*, and 11*c* is the same as patch resonator 6*a* of the first exemplary embodiment, and therefore, the description thereof will be omitted.

FIG. 9 illustrates an electric field distribution within treatment chamber 1 in the case where heating targets 8 and 9 are accommodated in microwave treatment apparatus 20B.

As shown in FIG. 9, the present exemplary embodiment can obtain almost the same electric field distribution as that obtained by the first exemplary embodiment (shown in FIG. 6A) using resonator unit 11 having a 1×3 segment configuration. The ratio of electric power absorbed by heating targets 8 and 9 is also the same as that in the first exemplary embodiment. This means that the present exemplary embodiment is able to make the structure of the resonator more comp act.

Third Exemplary Embodiment

Referring to FIGS. 10A to 10C and 11, microwave treatment apparatus 20C according to a third exemplary embodiment of the present disclosure will be described. In the following description, same or similar elements are designated by the same reference signs as used in the first and second exemplary embodiments, and the description of such same or similar elements will not be repeated.

Figure 10A:
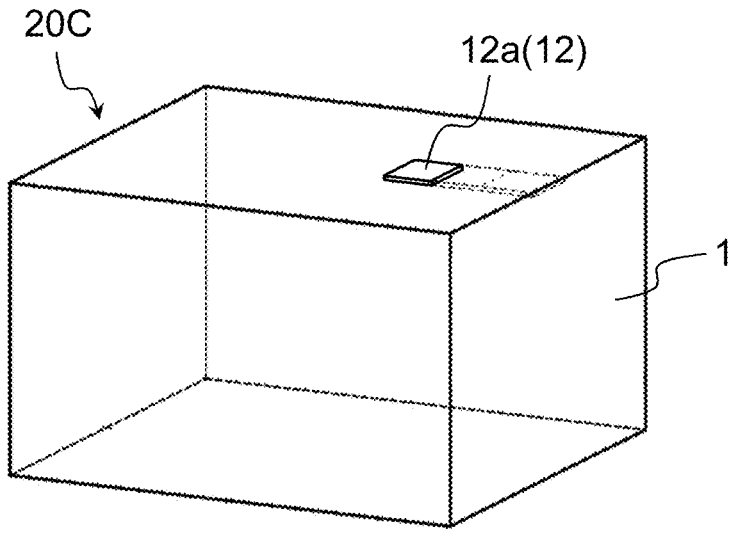
FIG. 10A is a view showing a position at which a resonator unit is to be arranged in a microwave treatment apparatus according to a third exemplary embodiment.
Figure 10B:
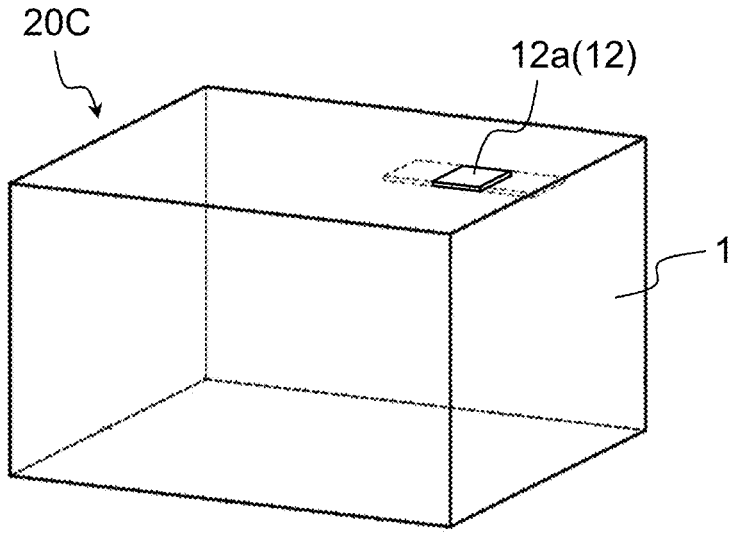
FIG. 10B is a view showing a position at which the resonator unit is to be arranged in the microwave treatment apparatus according to the third exemplary embodiment.
Figure 10C:
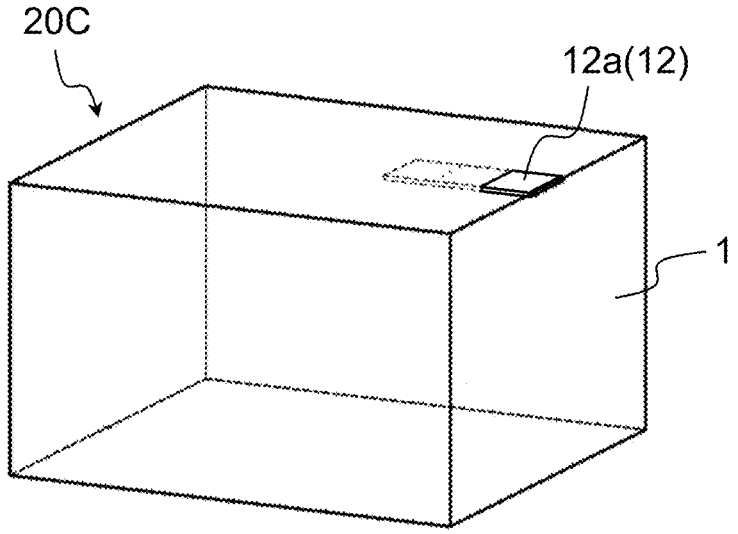
FIG. 10C is a view showing a position at which the resonator unit is to be arranged in the microwave treatment apparatus according to the third exemplary embodiment.

FIGS. 10A to 10C show the positions at which resonator unit 12 is to be arranged in microwave treatment apparatus 20C.

As shown in FIGS. 10A to 10C, microwave treatment apparatus 20C includes resonator unit 12 that includes only one patch resonator 12*a*, unlike microwave treatment apparatuses 20A and 20B.

In microwave treatment apparatus 20C shown in FIG. 10A, patch resonator 12*a* is disposed at the position at which patch resonator 11*a* is disposed in FIG. 8. In microwave treatment apparatus 20C shown in FIG. 10B, patch resonator 12*a* is disposed at the position at which patch resonator lib is disposed in FIG. 8. In microwave treatment apparatus 20C shown in FIG. 10C, patch resonator 12*a* is disposed at the position at which patch resonator 11*c* is disposed in FIG. 8.

Figure 11:
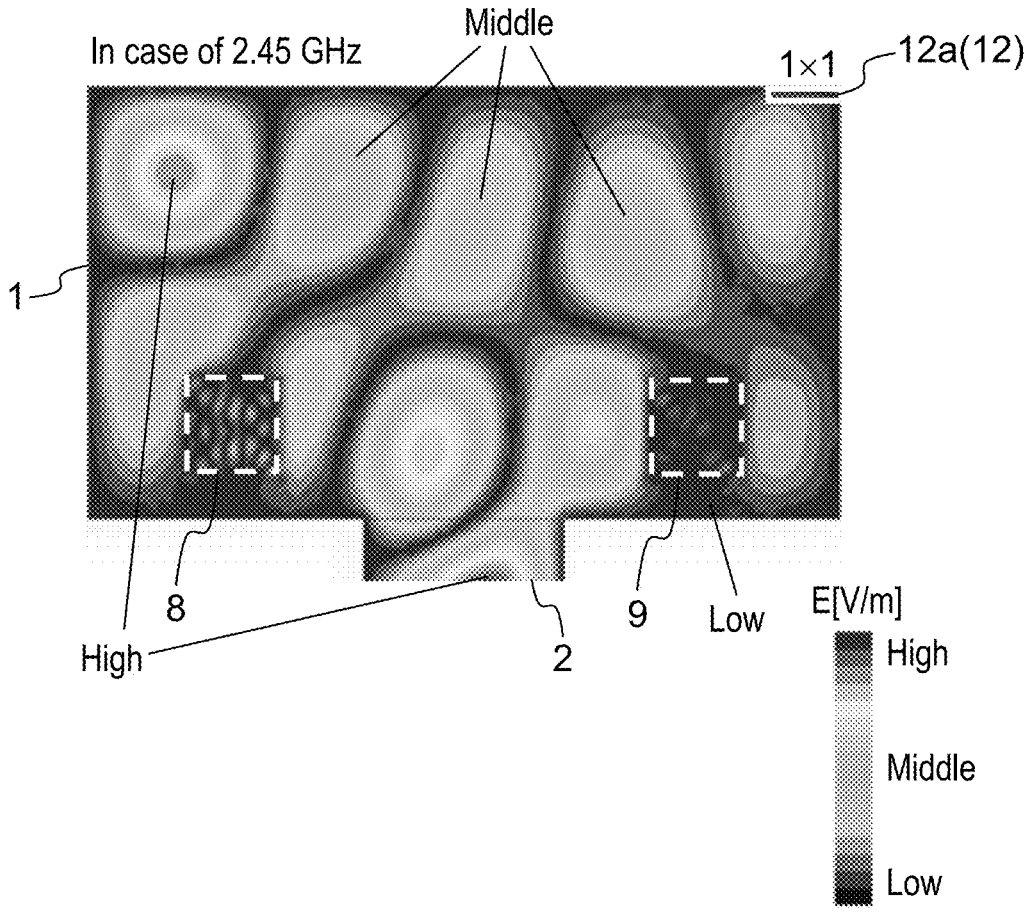
FIG. 11 is a view illustrating an electric field distribution in a treatment chamber of the microwave treatment apparatus according to the third exemplary embodiment.

FIG. 11 illustrates an electric field distribution within treatment chamber 1 in the case where a 2.45 GHz microwave is supplied to treatment chamber 1 that accommodates two heating targets, like FIG. 4.

Table 1 summarizes the area ratio of the resonator unit and the ratio of electric power absorbed by two heating targets, in relation to the segment configuration of the resonator unit and the placement position of the resonator unit. The term "area ratio of the resonator unit" refers to the proportion of the area of the resonator unit with respect to the area of the top wall of treatment chamber 1.

TABLE 1

| Segment configuration | Placement position of resonator unit | Area ratio | Ratio of absorbed electric power |
|---|---|---|---|
| 1 × 1 | See FIG. 10A | 1/81 | 0.8:1 |
| 1 × 1 | See FIG. 10B | 1/81 | 1.6:1 |
| 1 × 1 | See FIG. 10C | 1/81 | 2.0:1 |
| 1 × 3 | See FIG. 8 | 3/81 | 2.7:1 |
| 3 × 3 | See FIG. 1 | 9/81 | 2.7:1 |
| 5 × 4 | — | 20/81 | 2.0:1 |

Table 1 demonstrates the following. Based on the ratio of absorbed electric power, the best segment configuration of the resonator is 1×3 or 3×3.

If the ratio of absorbed electric power is permitted to be about 2.0:1, it is also possible to select the one-row by one-column (1×1) segment configuration.

In the 1×1 segment configuration, it is necessary to dispose resonator 12 at the optimum position. Nevertheless, the 1×1 segment configuration has a practical value from the viewpoint that it requires a smaller number of parts and a smaller packaging area.

For reference, Table 1 also shows the characteristic of a five-row by four-column (5×4) segment configuration (not shown in the figures). Table 1 demonstrates that increasing the number of patch resonators is not effective to improve the ratio of absorbed electric power. When the number of patch resonators increases, the practical value reduces because the number of parts and the area ratio accordingly increase.

Referring to Table 1, desirable results are obtained when nine patch resonators at most are provided so that the area ratio becomes equal to or less than 9/81 of the top wall.

The patch resonators may not have the same resonance frequency. It is possible that the patch resonators may have slightly different resonance frequencies so that the patch resonator that resonates can be switched from one to another sequentially according to the frequency of the supplied microwave.

In the case of 3×3 segment configuration in the present exemplary embodiment, when the top wall of treatment chamber 1 is equally divided (divided into three regions along the side-to-side axis and also into three regions along the forward and backward axis), the resonator unit is disposed in one of the divided regions (the rightmost one with respect to the side-to-side axis and the central one with respect to the forward and backward axis). However, the resonator unit may also be disposed in another one of the divided regions.

For example, by providing resonator units having different resonance frequencies in respective divided regions and controlling the frequencies of the supplied microwaves, it is possible that the standing wave distribution may be deflected not only in a direction along the side-to-side axis but also in a direction along the forward and backward axis. Moreover, it is also possible that, when, for example, a relatively large-sized heating target is placed at the center of treatment chamber 1, the central portion of the heating target may be heated more strongly or more weakly than the peripheral portion.

In the present exemplary embodiment, the resonator unit is disposed only on the top wall of treatment chamber 1. However, it is also possible to dispose the resonator unit on the right-side wall, for example. When the resonator unit is disposed on the right-side wall, it is believed that the standing wave on the right is deflected to the left. Thus, the resonator unit may be disposed on the right-side wall, not on the top wall, so that only heating target 8 is heated while heating target 9 is not heated.

When the resonator units are disposed both on the top wall and the right-side wall, it is possible that a ratio of 2.7:1 or higher may be obtained by a synergistic effect.

In one example, in the case where resonator unit 6 with a 3×3 segment configuration is disposed on the top wall of treatment chamber 1 having a width of 410 mm, a depth of 315 mm, and a height of 225 mm, the characteristic shown in FIG. 3 can be obtained by setting the thickness of the dielectric substrate to 0.6 mm, the relative dielectric constant to 3.5, tan δ to 0.004, and the radius of conductor 6*c* to 19.16 mm, for example.

Needless to say, as the energy of the supplied microwaves is greater, it is more likely that heat generation may occur, or spark may occur between adjacent patch resonators. Therefore, the present exemplary embodiment is especially effective in the case where the energy is low, such as in the case of chemical reaction treatment.

In the present exemplary embodiment, conductor 6*c* has a circular shape. However, conductor 6*c* may have other shapes, such as an elliptic shape or a quadrangular shape. When conductor 6*c* has a circular shape, the resonance frequency can be easily adjusted by adjusting the radius.

It is also possible that the change of the reflection phase within the frequency band of the supplied microwave may be made greater, in other words, a higher Q value may be obtained relative to the frequency.

INDUSTRIAL APPLICABILITY

A microwave treatment apparatus of the present disclosure is specifically a microwave oven. However, the present exemplary embodiments are not limited to microwave ovens, but may be applied suitably to other microwave treatment apparatuses, such as a heat treatment apparatus, a chemical reaction treatment apparatus, or a semiconductor manufacturing apparatus, which utilizes a dielectric heating process.

REFERENCE MARKS IN THE DRAWINGS

1 treatment chamber
2 microwave transmitter
3 power feeder
4 microwave generator
5 controller
11, 12 resonator unit
6*a*, 11*a*, 11*b*, 11*c*, 12*a* patch resonator
6*b* dielectric
6*c* conductor
7 mounting plate
8, 9 heating target
10 microwave
13 microwave supply
20A, 20B, 20C microwave treatment apparatus

The invention claimed is:

1. A microwave treatment apparatus comprising:
a treatment chamber surrounded by a plurality of walls and configured to accommodate a first heating target and a second heating target;
a microwave supply configured to supply a microwave to the treatment chamber; and
a resonator unit provided on one wall of the plurality of walls and having a resonance frequency in a frequency band of the microwave,
wherein the microwave supply includes:
a microwave generator configured to generate the microwave; and
a controller configured to control the microwave generator to adjust an oscillation frequency of the microwave, and
wherein the controller is configured to change the oscillation frequency according to an arrangement of the first heating target and the second heating target so as to simultaneously control heating of both the first heating target and the second heating target.

2. The microwave treatment apparatus according to claim 1, wherein the resonator unit includes one or more patch resonators.

3. The microwave treatment apparatus according to claim 2, wherein the one or more patch resonators are arranged so that a patch surface faces inside of the treatment chamber, and an opposite surface to the patch surface has a potential equal to a potential of the one wall of the treatment chamber.

4. The microwave treatment apparatus according to claim 2, wherein the one or more patch resonators are arranged in a matrix.

5. The microwave treatment apparatus according to claim 2, wherein all of the one or more patch resonators are provided on one wall of the plurality of walls.

6. The microwave treatment apparatus according to claim 5, wherein the resonator unit is disposed in one of equally divided regions in which one wall of the plurality of walls is equally divided.

7. The microwave treatment apparatus according to claim 1, wherein:
the microwave supply includes a power feeder provided in one wall of the plurality of walls and configured to supply the microwave to the treatment chamber; and
the resonator unit is disposed on another one of the walls that is opposite to the power feeder.

8. The microwave treatment apparatus according to claim 1, wherein the controller is configured to change the oscillation frequency in a range from 2.40 GHz to 2.50 GHz, inclusive, according to the arrangement of the first heating target and the second heating target.

9. The microwave treatment apparatus according to claim 1, wherein the controller is configured to change the oscillation frequency such that the first heating target is heated more intensively than the second heating target.

10. The microwave treatment apparatus according to claim 1, wherein the controller is configured to change the oscillation frequency such that the first heating target and the second heating target are heated evenly.

11. The microwave treatment apparatus according to claim 1, wherein the resonator unit includes only one patch resonator.

* * * * *